US005497850A

United States Patent [19]

Patterson

[11] Patent Number: 5,497,850

[45] Date of Patent: Mar. 12, 1996

[54] APPARATUS FOR LEVELING A LADDER

[76] Inventor: Ralph E. Patterson, Rte. 1, Box 317, New Cumberland, W. Va. 26047

[21] Appl. No.: 268,172

[22] Filed: Jun. 29, 1994

[51] Int. Cl.[6] ..... E06C 7/00

[52] U.S. Cl. ..... 182/204; 182/111

[58] Field of Search ..... 182/200, 205, 182/111; 248/188.5, 354.5

[56] References Cited

U.S. PATENT DOCUMENTS

| | | | |
|---|---|---|---|
| 4,496,025 | 1/1985 | Gattman . | |
| 4,669,576 | 6/1987 | Jones et al. . | |
| 5,107,958 | 4/1992 | Johnson . | |
| 5,222,575 | 6/1993 | Santos | 182/111 X |
| 5,232,067 | 8/1993 | Griffith . | |
| 5,273,133 | 12/1993 | Thocher et al. . | |
| 5,351,926 | 10/1994 | Moses | 248/354.5 |

FOREIGN PATENT DOCUMENTS

| | | | |
|---|---|---|---|
| 2665924 | 2/1992 | France | 182/201 |

*Primary Examiner*—Alvin C. Chin-Shue
*Attorney, Agent, or Firm*—Collard & Roe

[57] ABSTRACT

An apparatus and method of leveling a ladder, having hollow side rails, on an uneven surfaces using at least one leveling device. Support members, support holes and securing bolts maintain the leveling device at a desired height when disposed within the side rail of a ladder. A gripper foot, attached to the leveling device, provides a secure footing for the leveling device and the ladder its connected to.

14 Claims, 4 Drawing Sheets

APPARATUS FOR LEVELING A LADDER

BACKGROUND OF THE INVENTION

1. Field of the Invention

The present invention relates to ladders. More particularly, it relates to leveling ladders for use on uneven surfaces.

2. The Prior Art

The patent to Griffith, U.S. Pat. No. 5,232,067, discloses a stile extending attachment for a ladder. The invention consists of an attachment device for use on a ladder having hollow rungs and two side stile members. A long bolt is inserted through two of the hollow rungs and extending from one side stile through to the other and through the attachment device. The attachment device is releasably fastened by a nut and washer at each of the through bolts, thereby allowing the adjustment of the length of one of the two side stile members of the ladder.

The patent to Thocher et al., U.S. Pat. No. 5,273,133, discloses a ladder leveler. The invention consists of a mechanical gear system and extension member. Upon manually rotating the gear mechanism, the side member will extend or retract according to the direction of the rotation. A means for locking the gear system in place is provided.

U.S. Pat. No. 5,107,958 to Johnson, discloses a ladder leveler. The invention consists of a pair of leg extensions that are releasably affixed to the end of the side rails of the ladder. The extensions have a tightening bolt and a tension spring to secure the extension at a desired height. The extensions shown, fit over the end of the side rails and can be affixed thereto with screws or the like.

SUMMARY OF THE INVENTION

The present invention provides an apparatus and method of leveling a ladder whereby the leveling devices (i.e., leveling legs) are inserted into the end of the hollow side rails of the ladder. The leveling legs are adjustable in height by using a plurality of support holes in the leveling leg and the side rails of the ladder. A plurality of securing bolts, each having a diametrically disposed bore therein for receiving a cotter pin, are used to maintain the leveling leg at a desired height. Once inserted, the cotter pin will secure the bolt in place and thereby secure the leveling leg at the desired height.

It is therefore an object of the present invention to provide a ladder leveler that is easily and accurately adjusted.

It is another object of the present invention to provide a ladder leveler that can be installed on any ladder having hollow side rails.

Yet another object of the invention is to provide a ladder leveler that is reliable and easy to manufacture.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
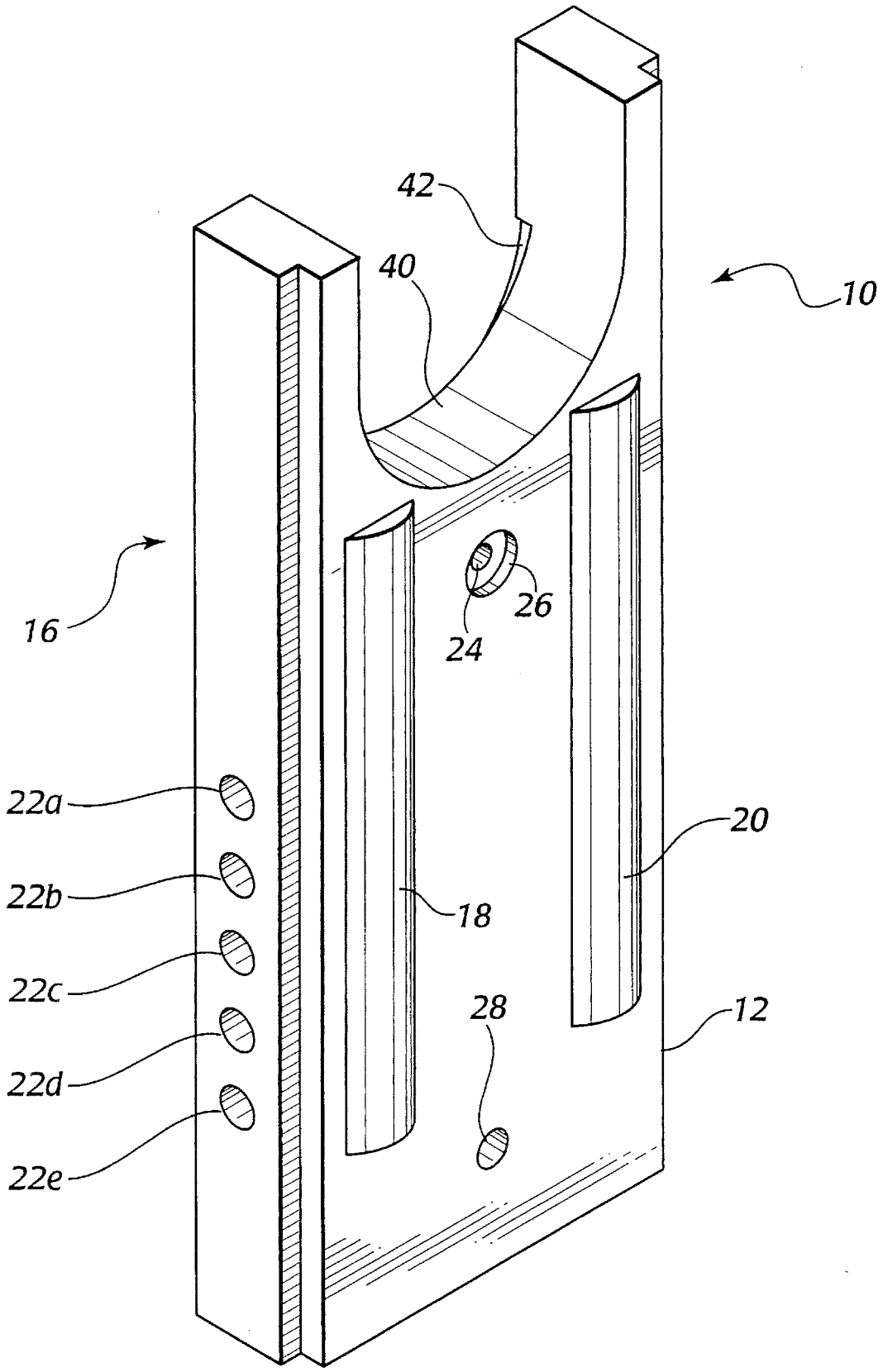
FIG. 1 is a perspective view of the leveling leg of the present invention.
Figure 2:
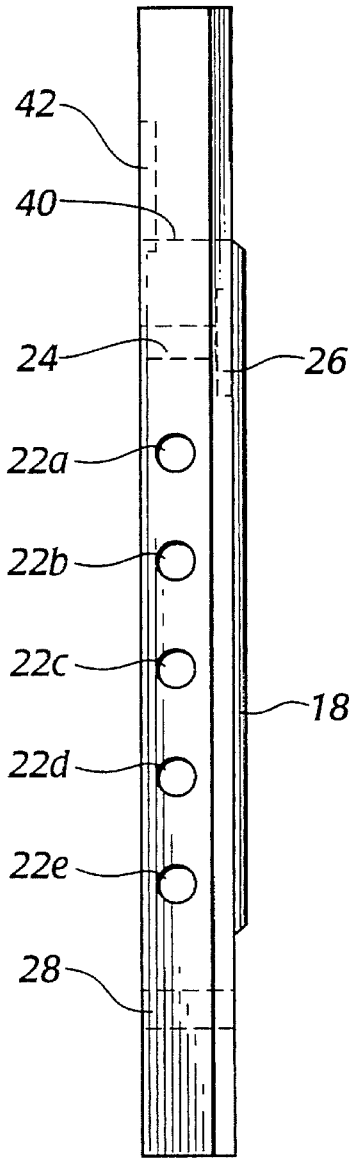
FIG. 2 is a side elevational view of the leveling leg of the present invention.
Figure 3:
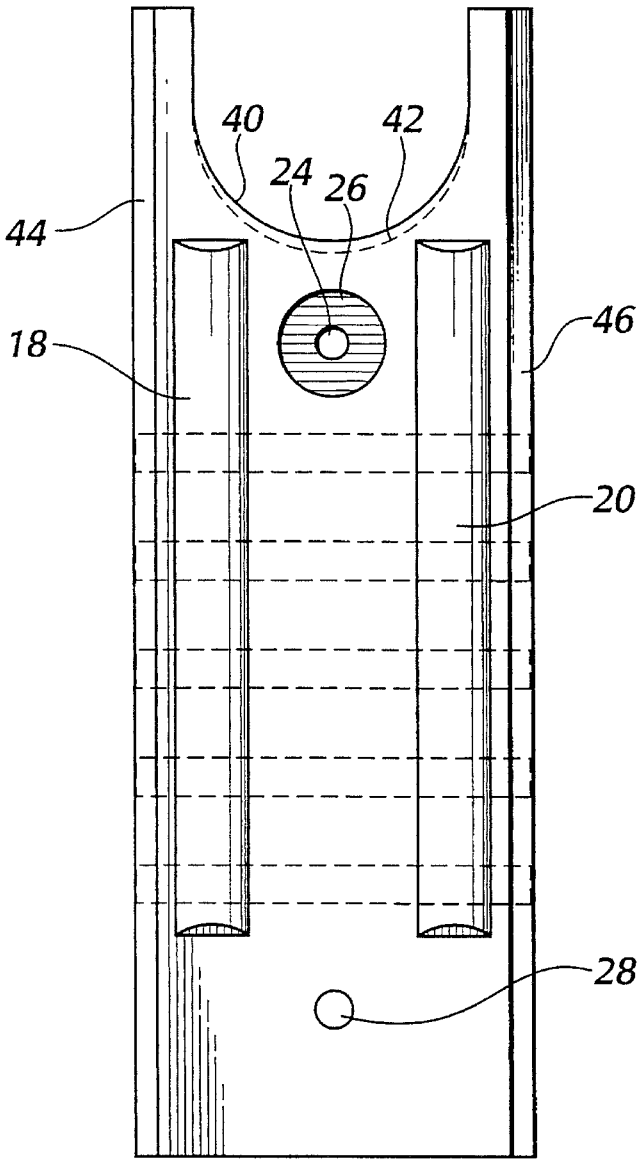
FIG. 3 is a front elevational view of the leveling leg of the present invention.

Turning now in detail to the drawings, FIGS. 1–3 show the ladder leveling leg 10 having a body 12 with an inner side 14 and an outer side 16. A pair of elongated semicylindrical support members 18 and 20 are disposed on inner side 14 of leveling leg 10. A plurality of holes **22*a*–22*e* extend through the width of leveling leg 10 from one side to the other. Holes 22*a*–22*e* provide a means for adjusting the height of leveling leg 10 when secured within a ladder. The top portion of leveling leg 10 has a U-shaped cutout 40 which allows leveling leg 10 to be inserted into the bottom of the side rails of a ladder and be adjusted so that U-shaped cutout 40 surrounds the lower most rung of the ladder. A second cutout 42 is provided in the curved portion of U-shaped cutout 40 and on the outer side 16 of leveling leg 10. The second cutout 42 can accommodate the fastening means used to secure the lower most rung to the side rails of the ladder. Thus, cutout 42 allows leveling leg 10** to be inserted into the side rail of the ladder without interfering with the fastening means used to affix the lower rung to the ladder.

A bore 24, centrally located immediately below cutout 40 and extending through leveling leg 10 from inner side 14 to outer side 16, further secures leveling leg 10 in the desired position within the ladder. A recess 26, concentrically disposed around bore 24, is designed to receive a washer for securing a bolt through securing hole 24.

A gripper support hole 28 is provided near the bottom of leveling leg 10 and centrally disposed therein. Gripper hole 28 is used to secure a gripper foot 56 (FIG. 4) to leveling leg 10 to prevent the ladder from slipping.

Figure 4:
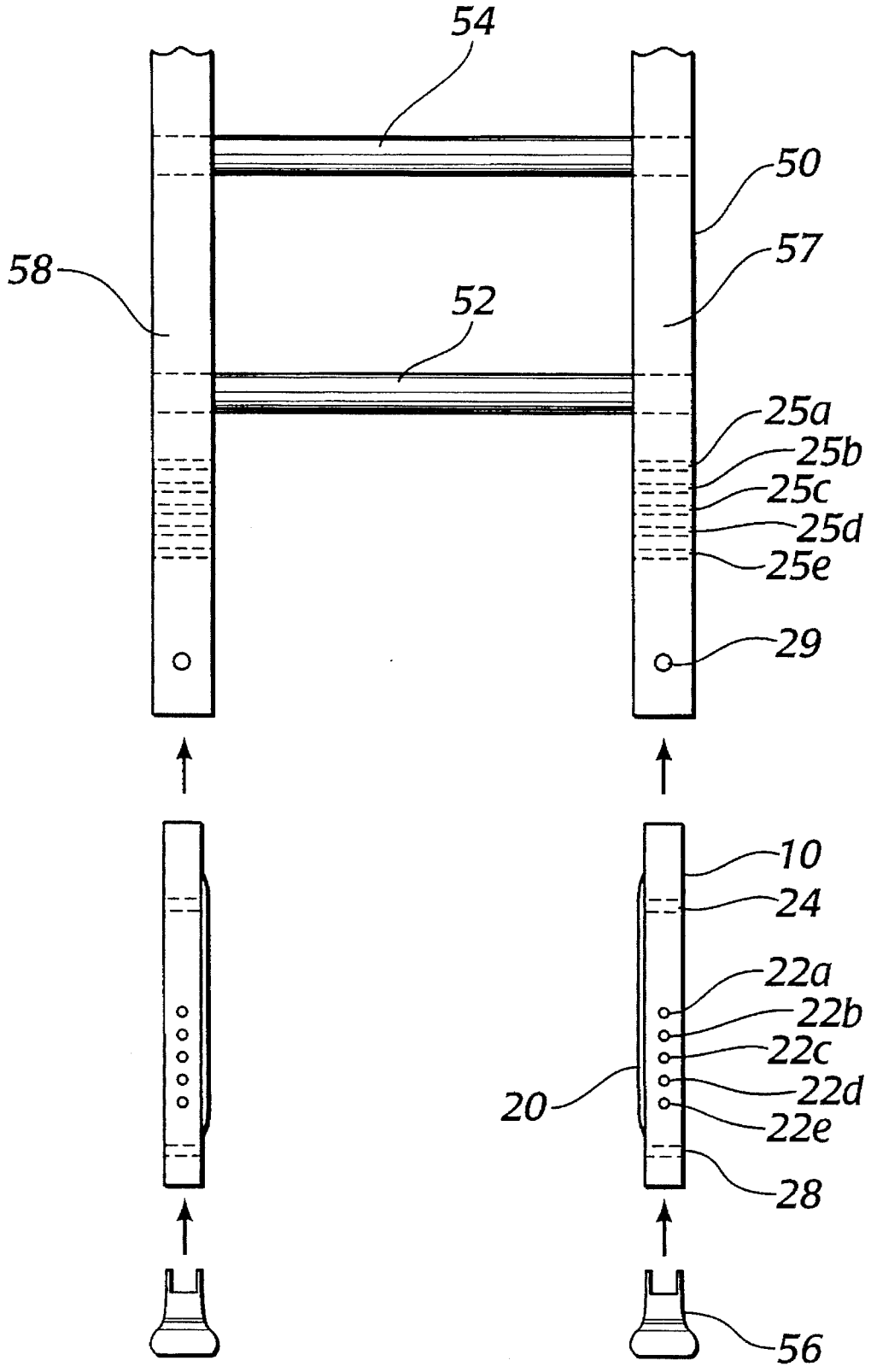
FIG. 4 is a schematic view of the ladder and leveling legs of the present invention.

FIG. 4 shows a ladder 50 having side rails 57 and 58 with rungs 52 and 54 therebetween. A plurality of first support holes **25*a*–25*e* are disposed in the lower portion of side rails 57 and 58 and extend through said side rails parallel to rungs 52 and 54. A single second support hole 29, disposed in the lower portion of both side rails 57 and 58, extends through said side rails from the front to the back of ladder 50 and perpendicular with respect to rungs 52 and 54**.

When leveling leg 10 is inserted into the lower end of side rail 57, bore 24 can be aligned with any one of the first support holes **25*a*–25*e* depending on the desired height. Once bore 24 is aligned with one of first support holes 25*a*–25*e*, one of the plurality of holes 22*a*–22*e* on leveling leg 10 will automatically be aligned with second support hole 29 in side rail 57. When the leveling leg is at the desired height, a securing bolt 60 (FIG. 6) is inserted through the respective support holes in side rail 57, of ladder 50, and leveling leg 10 to maintain said leveling leg in a fixed position. A gripper foot 56 is releasably fastened to leveling leg 10 through gripper support hole 28. Gripper foot 56 prevents leveling leg 10** from slipping when placed on the ground.

Figure 5:
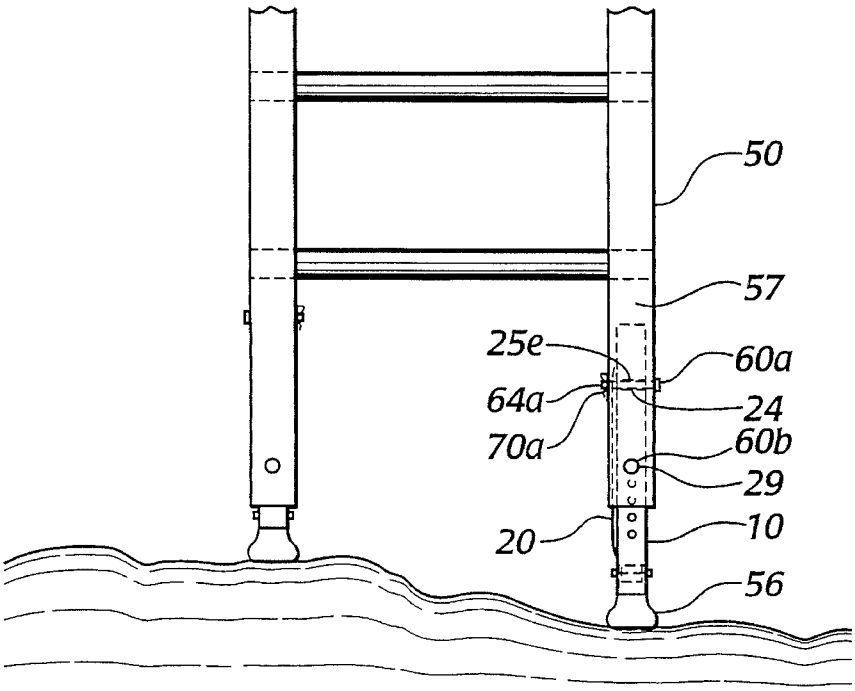
FIG. 5 is an elevational view showing the leveling legs used on an uneven surface.
Figure 6:
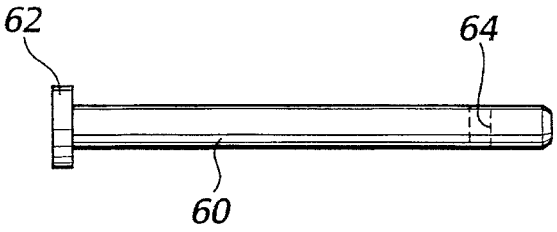
FIG. 6 is the securing bolt of the invention.
Figure 7:
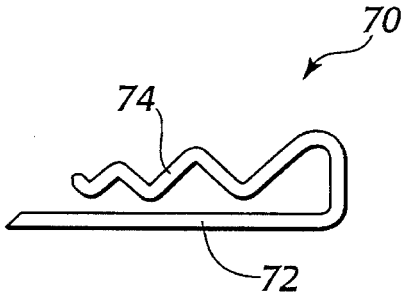
FIG. 7 is the cotter pin used by the present invention.

Referring to FIGS. 5–7, leveling leg 10 is shown inserted in side rail 57. A securing bolt 60 has a head 62 and a diametrically disposed bore 64 near the end opposite said head. A cotter pin 70 is used to hold bolt 60 in place after said bolt has been inserted to secure leveling leg 10 in place. Cotter pin 70 has a straight portion 72 and a spring portion 74. Straight portion 72 of cotter pin 70 is inserted into diametrically disposed bore 64 of bolt 60 and spring portion 74 engages bolt 60 to hold cotter pin 70 in place.

As shown in FIG. 5, securing bolt 60*a* is shown passing through support hole 25*e* in side rail 57 and through bore 24 in leveling leg 10. Cotter pin 70*a* is shown disposed through diametrically disposed bore 64*a* (not shown) in bolt 60*a*, thereby maintaining said bolt in a fixed position. Bolt 60*b* is shown disposed through second support hole 29 in side rail 57 to further secure leveling leg 10 at the desired height. Gripper boot 56 is releasably fastened to leveling leg 10 using a releasable fastener of any suitable known type.

Although leveling leg 10 is shown having a substantially rectangular shape, leveling leg 10 can be of any suitable known shape, such as, for example, cylindrical, oval or elliptical to accommodate a variety of different shaped side rails While one embodiment of the present invention has been shown and described, it is to be understood that many changes and modifications may be made thereunto without departing from the spirit and scope of the invention as defined in the appended claims.

I claim:

1. An apparatus in combination with a ladder for leveling the ladder on an uneven surface the combination comprising:

a ladder having two hollow side rails connected by a plurality of rungs equally spaced from each other and disposed at increasing height along the side rails, each of the side rails having a front, a back, an outer side, an inner side, a top and a bottom;

at least one leveling leg substantially rectangular in shape and having a front, a back, an inner side, an outer side, a top and a bottom, said at least one leveling leg being inserted into the bottom of at least one of the hollow side rails of the ladder, said top of said at least one leveling leg having a U-shaped cutout with two straight portions and a curved portion, said cutout enabling said at least one leveling leg to be inserted into the side rail of the ladder and fit around the lower most rung of the ladder, said at least one leveling leg having a notch disposed on said outer side of said leveling leg and along said curved portion of said U-shaped cutout, said notch further enabling said at least one leveling leg to fit around the lower most rung of the ladder when inserted into the side rail; and securing means for securing said at least one leveling leg to the ladder.

2. The apparatus according to claim 1, wherein said securing means further comprises a first securing means and a second securing means.

3. The apparatus according to claim 2, wherein said first securing means comprises:

a plurality of first support holes in at least one of the side rails of the ladder and below the lower most rung, said plurality of first support holes being equally spaced from each other and extending through the side rail from the inner side to the outer side;

a bore in said at least one leveling leg, said bore disposed near said top of said leveling leg and extending therethrough from said inner side to said outer side;

a first securing bolt having a diametrically disposed bore therein, whereby said bolt is inserted through one of said plurality of first support holes in the side rail of the ladder and through said bore in said at least one leveling leg such that said first securing bolt extends from the outer side of the side rail through said bore in said leveling leg to the inner side of the side rail of the ladder; and a first cotter pin releasably disposed in said diametrically disposed bore in said first securing bolt for maintaining said first securing bolt in a fixed position.

4. The apparatus according to claim 3, wherein said bore in said at least one leveling leg includes a recess concentrically disposed around said bore on said inner side of said at least one leveling leg, said recess for receiving a washer.

5. The apparatus according to claim 2, wherein said second securing means comprises:

a second support hole in at least one of the side rails of the ladder near the bottom thereof, said second support hole extending through said side rail from the front to the back;

a plurality of holes disposed in said at least one leveling leg, said plurality of holes being equally spaced from each other and extending through said at least one leveling leg from said front to said back;

a second securing bolt having a diametrically disposed bore therein, whereby said bolt is inserted through said second support hole in the side rail of the ladder and through one of said plurality of holes in said at least one leveling leg such that said second securing bolt extends from the front of the side rail of the ladder through one of said plurality of holes in said at least one leveling leg to the back of the side rail of the ladder; and a second cotter pin releasably disposed in said diametrically disposed bore in said second securing bolt for maintaining said second securing bolt in a fixed position.

6. The apparatus according to claim 3, wherein said first securing bolt extends beyond the inner side of the side rail of the ladder such that said diametrically disposed bore in said bolt is accessible from the inner side of the side rail of the ladder, whereby said first cotter pin can be inserted into said bore in said first securing bolt.

7. The apparatus according to claim 5, wherein said second securing bolt extends beyond the back of the side rail of the ladder such that said diametrically disposed bore in said bolt is accessible from the back of the side rail of the ladder, whereby said second cotter pin can be inserted into said bore in said second securing bolt.

8. The apparatus according to claim 1, wherein said at least one leveling leg further comprises:

support means disposed on said at least one leveling leg for supporting said leveling leg within the hollow side rails of the ladder; and a gripper boot releasably fastened to said bottom of said at least one leveling leg for providing a secure footing for said leveling leg and the ladder.

9. The apparatus according to claim 8, wherein said support means consists of two elongated parallel spaced semi-cylindrical members disposed on said inner side of said leveling leg.

10. An apparatus in combination with a ladder for leveling the ladder on an uneven surface the combination comprising:

a ladder having two hollow side rails connected by a plurality of rungs equally spaced from each other and disposed at increasing height along the side rails, each of the side rails having a front, a back, an outer side, an inner side, a top and a bottom;

at least one leveling leg substantially rectangular in shape and having a front, a back, an inner side, an outer side, a top and a bottom, said at least one leveling leg being inserted into the bottom of at least one of the hollow side rails of the ladder;

a first securing means for securing said at least one leveling leg to the ladder, said first securing means comprises:

a plurality of first support holes in at least one of the side rails of the ladder and below the lower most rung, said plurality of first support holes being equally spaced from each other and extending through the side rail from the inner side to the outer side;

a bore in said at least one leveling leg, said bore disposed near said top of said leveling leg and extending therethrough from said inner side to said outer side, said bore in said at least one leveling leg including a recess concentrically disposed around said bore on said inner side of said leveling leg, said recess for receiving a washer; and a first securing bolt having a diametrically disposed bore therein, whereby said bolt is inserted through one of said plurality of first support holes in the side rail of the ladder and through said bore in said at least one leveling leg such that said first securing bolt extends from the outer side of the side rail through said bore in said leveling leg to the inner side of the side rail of the ladder; and a first cotter pin releasably disposed in said diametrically disposed bore in said first securing bolt for maintaining said first securing bolt in a fixed position;

a second securing means for further securing said at least one leveling leg to the ladder, said second securing means comprises:

a second support hole in at least one of the side rails of the ladder near the bottom thereof, said second support hole extending through said side rail from the front to the back;

a plurality of holes disposed in said at least one leveling leg, said plurality of holes being equally spaced from each other and extending through said at least one leveling leg from said front to said back;

a second securing bolt having a diametrically disposed bore therein, whereby said bolt is inserted through said second support hole in the side rail of the ladder and through one of said plurality of holes in said at least one leveling leg such that said second securing bolt extends from the front of the side rail of the ladder through one of said plurality of holes in said at least one leveling leg to the back of the side rail of the ladder; and a second cotter pin releasably disposed in said diametrically disposed bore in said second securing bolt for maintaining said second securing bolt in a fixed position;

support means disposed on said at least one leveling leg for supporting said at least one leveling leg within the side rails of the ladder, said support means comprising two elongated parallel spaced semi-cylindrical members disposed on said inner side of said at least one leveling leg; and a gripper boot releasably fastened to said bottom of said at least one leveling leg for providing a secure footing for said leveling leg.

11. The apparatus according to claim 10, wherein said first securing bolt extends beyond the inner side of the side rail of the ladder such that said diametrically disposed bore in said bolt is accessible from the inner side of the side rail of the ladder, whereby said first cotter pin can be inserted into said bore in said first securing bolt.

12. The apparatus according to claim 10, wherein said second securing bolt extends beyond the back of the side rail of the ladder such that said diametrically disposed bore in said bolt is accessible from the back side of the side rail of the ladder, whereby said second cotter pin can be inserted into said bore in said second securing bolt.

13. The apparatus according to claim 10, wherein said top of said at least one leveling leg has a U-shape cutout with two straight portions and a curved portion, said cutout enabling said at least one leveling leg to be inserted into the side rail of the ladder and fit around the lower most rung of the ladder.

14. The apparatus according to claim 10, wherein said at least one leveling leg has a notch disposed on said outer side of said leveling leg and along said curved portion of said U-shaped cutout, said notch further enabling said at least one leveling leg to fit around the lower most rung of the ladder when inserted into the side rail.

* * * * *